US011333003B2

(12) United States Patent
Hardesty et al.

(10) Patent No.: US 11,333,003 B2
(45) Date of Patent: May 17, 2022

(54) OPENING A CASING WITH A HYDRAULIC-POWERED SETTING TOOL

(71) Applicant: GEODYNAMICS, INC., Millsap, TX (US)

(72) Inventors: John T. Hardesty, Fort Worth, TX (US); Dennis Roessler, Fort Worth, TX (US)

(73) Assignee: GEODynamics, Inc., Millsap, TX (US)

( * ) Notice: Subject to any disclaimer, the term of this patent is extended or adjusted under 35 U.S.C. 154(b) by 0 days.

(21) Appl. No.: 16/635,263

(22) PCT Filed: Mar. 16, 2018

(86) PCT No.: PCT/US2018/022841

§ 371 (c)(1),
(2) Date: Jan. 30, 2020

(87) PCT Pub. No.: WO2019/027509

PCT Pub. Date: Feb. 7, 2019

(65) Prior Publication Data

US 2020/0182016 A1 Jun. 11, 2020

Related U.S. Application Data

(60) Provisional application No. 62/540,333, filed on Aug. 2, 2017.

(51) Int. Cl.

| | |
|---|---|
| ***E21B 34/14*** | (2006.01) |
| ***E21B 23/03*** | (2006.01) |
| ***E21B 43/26*** | (2006.01) |

(52) U.S. Cl.

CPC ..... *E21B 34/14* (2013.01); *E21B 23/03* (2013.01); *E21B 43/26* (2013.01); *E21B 2200/06* (2020.05)

(58) Field of Classification Search

CPC ..... E21B 34/14; E21B 23/03; E21B 43/26; E21B 2200/06

(Continued)

(56) References Cited

U.S. PATENT DOCUMENTS

| | | | |
|---|---|---|---|
| 4,917,191 | A | 4/1990 | Hopmann et al. |
| 5,044,443 | A | 9/1991 | Churchman et al. |

(Continued)

FOREIGN PATENT DOCUMENTS

| | | | |
|---|---|---|---|
| CN | 103883280 | A | 6/2014 |
| CN | 104968888 | A | 10/2015 |

(Continued)

OTHER PUBLICATIONS

International Search Report/Written Opinion of the International Searching Authority in related/corresponding PCT Application No. PCT/US2018/022841 dated Jun. 8, 2018.

(Continued)

*Primary Examiner* — Matthew R Buck
*Assistant Examiner* — Patrick F Lambe
(74) *Attorney, Agent, or Firm* — Morgan, Lewis & Bockius LLP

(57) ABSTRACT

A setting tool for opening and dosing a sleeve inside a casing includes a body extending along a central longitudinal axis (X); a set of holding dogs located around the body; and a set of sleeve dogs located around the body. The set of sleeve dogs are configured to move along the central longitudinal axis (X) relative to the set of holding dogs.

20 Claims, 19 Drawing Sheets

(58) Field of Classification Search
USPC ..... 166/308.1
See application file for complete search history.

(56) References Cited

U.S. PATENT DOCUMENTS

| | | | | |
|---|---|---|---|---|
| 5,137,086 | A * | 8/1992 | Stokley | E21B 49/082 166/191 |
| 6,763,892 | B2 | 7/2004 | Kaszuba | |
| 7,357,183 | B2 | 4/2008 | Gazewood | |
| 9,121,247 | B2 | 9/2015 | George et al. | |
| 9,121,252 | B2 | 9/2015 | George et al. | |
| 9,650,866 | B2 | 5/2017 | George et al. | |
| 2001/0013412 | A1 | 8/2001 | Tubel | |
| 2011/0198096 | A1 | 8/2011 | Mailand et al. | |
| 2012/0325499 | A1 | 12/2012 | Moffitt | |
| 2014/0251619 | A1 | 9/2014 | George et al. | |
| 2014/0352944 | A1 | 12/2014 | Devarajan et al. | |
| 2017/0074070 | A1 | 3/2017 | Hay | |
| 2017/0370189 | A1* | 12/2017 | MacDougall | E21B 23/01 |

FOREIGN PATENT DOCUMENTS

| | | | |
|---|---|---|---|
| CN | 105822278 | A | 8/2016 |
| CN | 105840163 | A | 8/2016 |
| GB | 2310678 | A | 9/1997 |
| GB | 2530834 | A | 4/2016 |
| WO | 2011100748 | A2 | 8/2011 |

OTHER PUBLICATIONS

Communication Pursuant to Rules 70(2) and 70a(2) EPC for corresponding/related European Application No. 18842127.5, dated Mar. 16, 2021.

Extended European Search Report for corresponding/related European Application No. 18842127.5, dated Feb. 25, 2021.

Office Action in related/corresponding Chinese Patent Application No. 2018800640305 dated Aug. 30, 2021.

* cited by examiner

OPENING A CASING WITH A HYDRAULIC-POWERED SETTING TOOL

BACKGROUND

Technical Field

Embodiments of the subject matter disclosed herein generally relate to downhole tools for perforating operations, and more specifically, to a casing string having one or more casing valves that are opened and closed with a hydraulic-powered setting tool for fracturing a desired formation.

Discussion of the Background

After a well 100 is drilled to a desired depth H relative to the surface 111, as illustrated in FIG. 1, and the casing string 110 protecting the wellbore 104 has been installed and cemented in place, it is time to connect the wellbore 104 to the subterranean formation 106 to extract the oil and/or gas.

The typical process of connecting the casing to the subterranean formation may include the following steps: (1) placing a plug 112 with a through port 114 (known as a frac plug) above a just stimulated stage 116, and (2) perforating a new stage 118 above the plug 112. The step of perforating is achieved with a gun string 120 that is lowered into the well with a wireline 122. A controller 124 located at the surface controls the wireline 122 and also sends various commands along the wireline to actuate one or more gun assemblies of the gun string.

A traditional gun string 120 includes plural carriers 126 connected to each other by corresponding subs 128, as illustrated in FIG. 1. Each sub 128 includes a detonator 130 and a corresponding switch 132. The corresponding switch 132 is actuated by the detonation of a downstream gun. When this happens, the detonator 130 becomes connected to the through line, and when a command from the surface actuates the detonator 130, the upstream gun is actuated. This process is expensive, time consuming and dangerous as the gun includes shaped charges, which include explosive materials.

U.S. Pat. No. 6,763,892 discloses a different approach for fracturing a well, in which the individual casing tubes forming the casing string are provided with a corresponding sliding sleeve, i.e., a casing valve. The sliding sleeve can be opened or closed as desired with the help of a plurality of seals and ports. The fracturing of the formation around the casing can then be performed through the openings formed in the casing string.

However, this specific implementation is burdensome because the casing valve includes a number of individual components that are threaded to each other and use plural seals, which may fail and leak. In addition, this specific implementation cannot withstand the torque specifications of a typical wellbore casing because of the threaded components.

Thus, there is a need to provide a casing valve that can withstand the torque specifications in the wellbore casing, is not prone to leaks and is easy to open and close when a fracturing operation is desired.

SUMMARY

According to an embodiment, there is a setting tool for opening and closing a sleeve inside a casing. The setting tool includes a body extending along a central longitudinal axis (X), a set of holding dogs located around the body, and a set of sleeve dogs located around the body. The set of sleeve dogs are configured to move along the central longitudinal axis (X) relative to the set of holding dogs.

According to another embodiment, there is system for fracturing a well. The system includes a casing having plural openings that are covered by a sleeve when the sleeve is in a close position, and a setting tool configured to open the sleeve for fracturing operations. The setting tool includes a body extending along a central longitudinal axis (X), a set of holding dogs located around the body, and a set of sleeve dogs located around the body. The set of sleeve dogs are configured to move along the central longitudinal axis (X) relative to the set of holding dogs.

According to still another embodiment, there is a method for fracturing a well. The method includes lowering a setting tool inside a casing having plural openings covered by a sleeve, engaging a set of holding dogs of the setting tool with a corresponding holding groove formed inside the casing, engaging a set of sleeve dogs of the setting tool with a corresponding sleeve groove formed in the sleeve, and opening the sleeve by translating the sleeve dogs along a central longitudinal axis X, relative to the holding dogs.

BRIEF DESCRIPTION OF THE DRAWINGS

The accompanying drawings, which are incorporated in and constitute a part of the specification, illustrate one or more embodiments and, together with the description, explain these embodiments. In the drawings:

FIG. 5A illustrates the setting tool without holding dogs, sleeve dogs and a seal while

DETAILED DESCRIPTION

The following description of the embodiments refers to the accompanying drawings. The same reference numbers in different drawings identify the same or similar elements. The following detailed description does not limit the invention.

Instead, the scope of the invention is defined by the appended claims. The following embodiments are discussed, for simplicity, with regard to a casing having a valve and a hydraulic-powered setting tool that opens and closes the casing valve. However, the embodiments discussed herein are also applicable to a device that has a valve that needs to be closed and opened under tight conditions.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
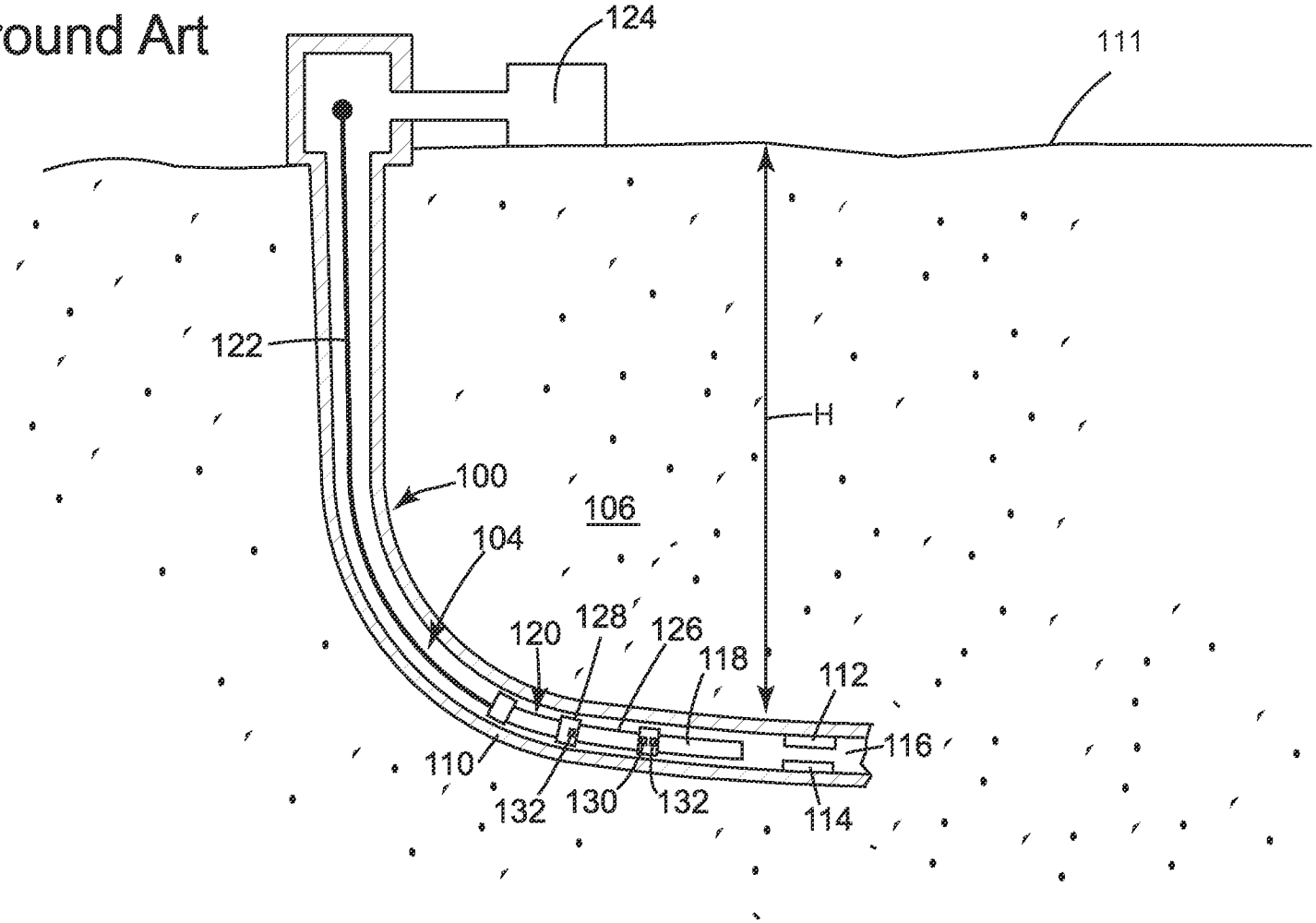
FIG. 1 Background Art
FIG. 1 illustrates a well and associated equipment for well completion operations.
Figure 2:
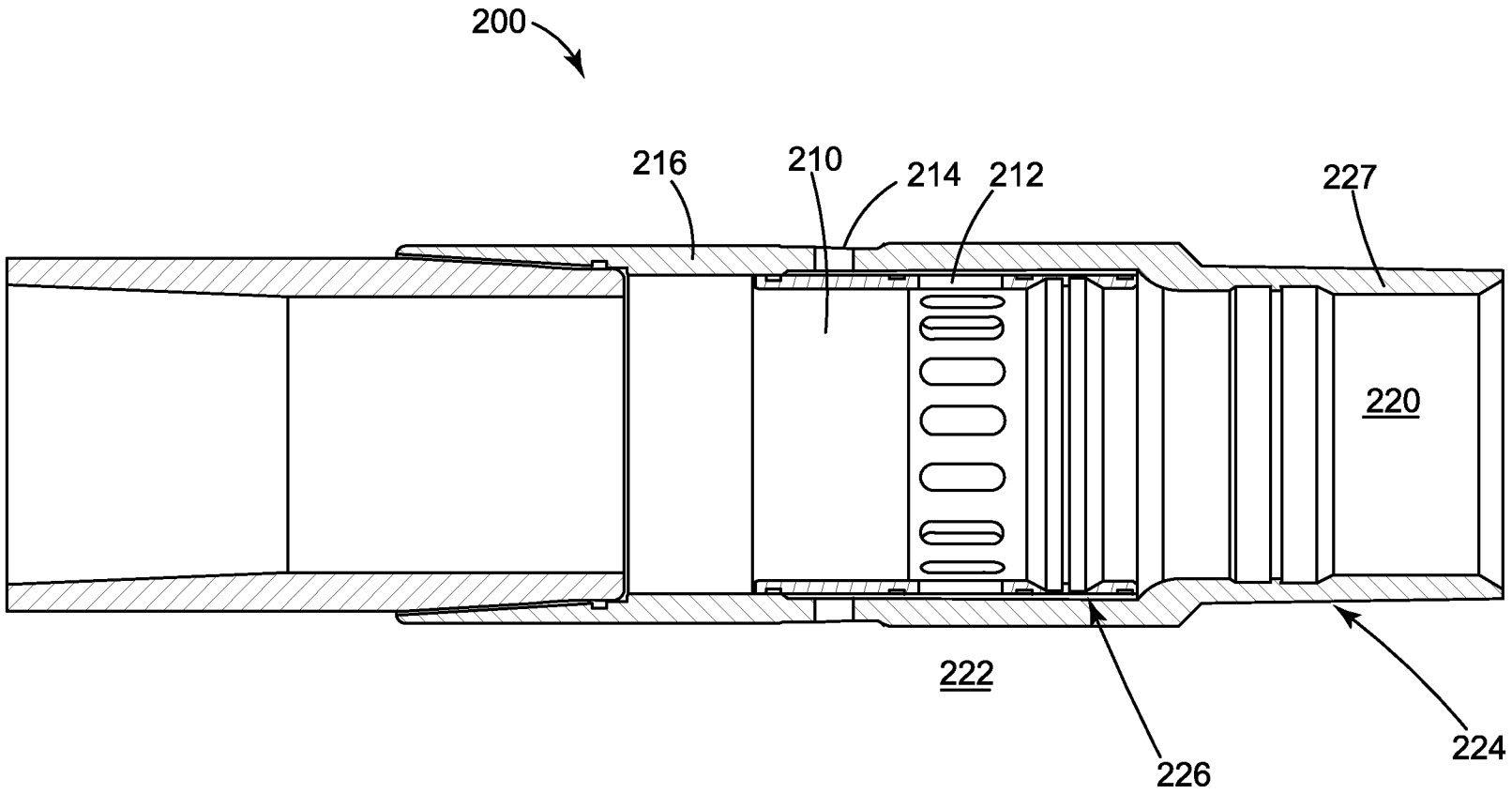
FIG. 2 illustrates a casing having a sleeve.

According to an embodiment illustrated in FIG. 2, a casing 200 (sometimes called a casing valve) has an interior sleeve 210. Interior sleeve 210 has plural sleeve openings 212 that corresponds to plural casing openings 214 formed in the body 216 of the casing 200. The sleeve 210 is shown closed in FIG. 2, i.e., a fluid 220 inside the casing 200 cannot move outside the body 216 through casing openings 214. However, if the sleeve 210 is moved to the left and the sleeve openings 212 are aligned with the casing openings 214, then the fluid 220 communicates with the outside 222 of the casing. Note that an interior diameter of the sleeve 210 is larger than a diameter of a seal region 227 so that the sleeve cannot enter the seal region for reasons to be discussed later. Further note that an interior of body 216 has a latching groove 224 and an interior of sleeve 210 has a latching groove 226, also to be discussed later. A set of latching grooves 224 are formed inside the seal region 227 and the other set of latching grooves 226 are formed onto the sleeve 210.

Figure 3:
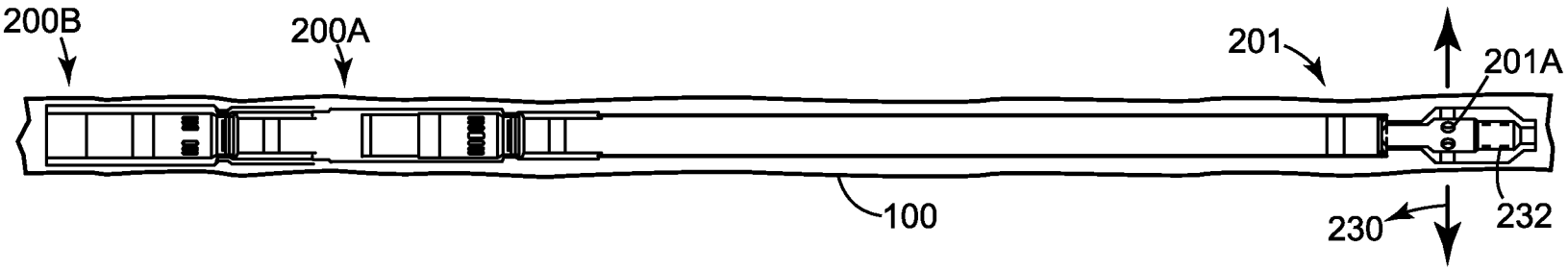
FIG. 3 illustrates a casing string that ends with a toe valve.

Plural casings 200A and 200B (only two are shown for simplicity, but a casing string may include tens or hundreds of casings) are shown in FIG. 3 distributed in the well 100. The last casing 200A is connected to a tow valve 201. Just before the fracturing operation, all the valves (sleeves) are closed. The toe valve 201 (an example of which is described in U.S. Pat. Nos. 9,121,247, 9,121,252, and 9,650,866) has a disk that breaks when the pressure inside the casing becomes larger than a certain threshold pressure. When this happens, a piston inside a wall of the toe valve is actuated and moves to open the openings 201A formed through the toe valve. In this way, the toe valve stage may be fractured by the fluid 230 pumped from the surface. A wiper plug 232 has been previously pumped to the bottom of the well, past the toe valve 201 for preventing the fracturing fluid 230 to move past the toe valve. After the fracturing operation of the toe valve stage is finalized, the toe valve may be used to expel the pumped fluid into the formation.

To reveal the openings of the top casing of the casing string, a hydraulic-powered setting tool is placed into the well and controlled to attach to the sleeve of the casing. According to an embodiment illustrated in FIG. 4, the hydraulic-powered setting tool (setting tool herein) 400 has a body 402 connected to a hydraulic valve block 404 that includes plural valves 406. Valves 406 are configured to allow in and out a fluid under pressure to activate various pistons as discussed later. In one embodiment, there are three different pistons that need to be actuated and each piston is actuated by a pair of valves. For this reason, the figure shows 6 valves. However, one skilled in the art would understand that more or less valves may be used for the setting tool.

Setting tool 400 also includes a first set of connecting elements 420, called herein holding dogs because these elements would engage corresponding grooves in the casing valve and fix the setting tool relative to the casing. The setting tool also includes a second set of connecting elements 430, called herein sleeve dogs because these elements would engage the sleeve of the casing valve and move it from the closed position to the open position and vice versa. The dogs are mechanical elements that mate with corresponding grooves formed in the body of the casing and/or the sleeve.

The setting tool 400 further includes a seal 440, located downstream from the first and second set of dogs. The setting tool 400 further includes an electronics module 450 and a fishing neck 452. The electronics module 450 includes various sensors, e.g., pressure transducer 454, velocity sensor 456, accelerometers, etc., that may be connected to a wireline for communicating and/or receiving various information to the surface. The hydraulic valve block 404 may include similar or additional sensors. In one application, the hydraulic valve block 404 includes a pressure transducer 408 and a power source 410. The power source 410 may include one or more batteries. In one application, the power source 410 includes about 100 AA lithium batteries. The hydraulic valve block 404 may also include a controller 412, that is connected to the various sensors noted above and which is configured to open and close one or more or the valves 406 so that a corresponding piston moves up and down the well.

Figure 4:
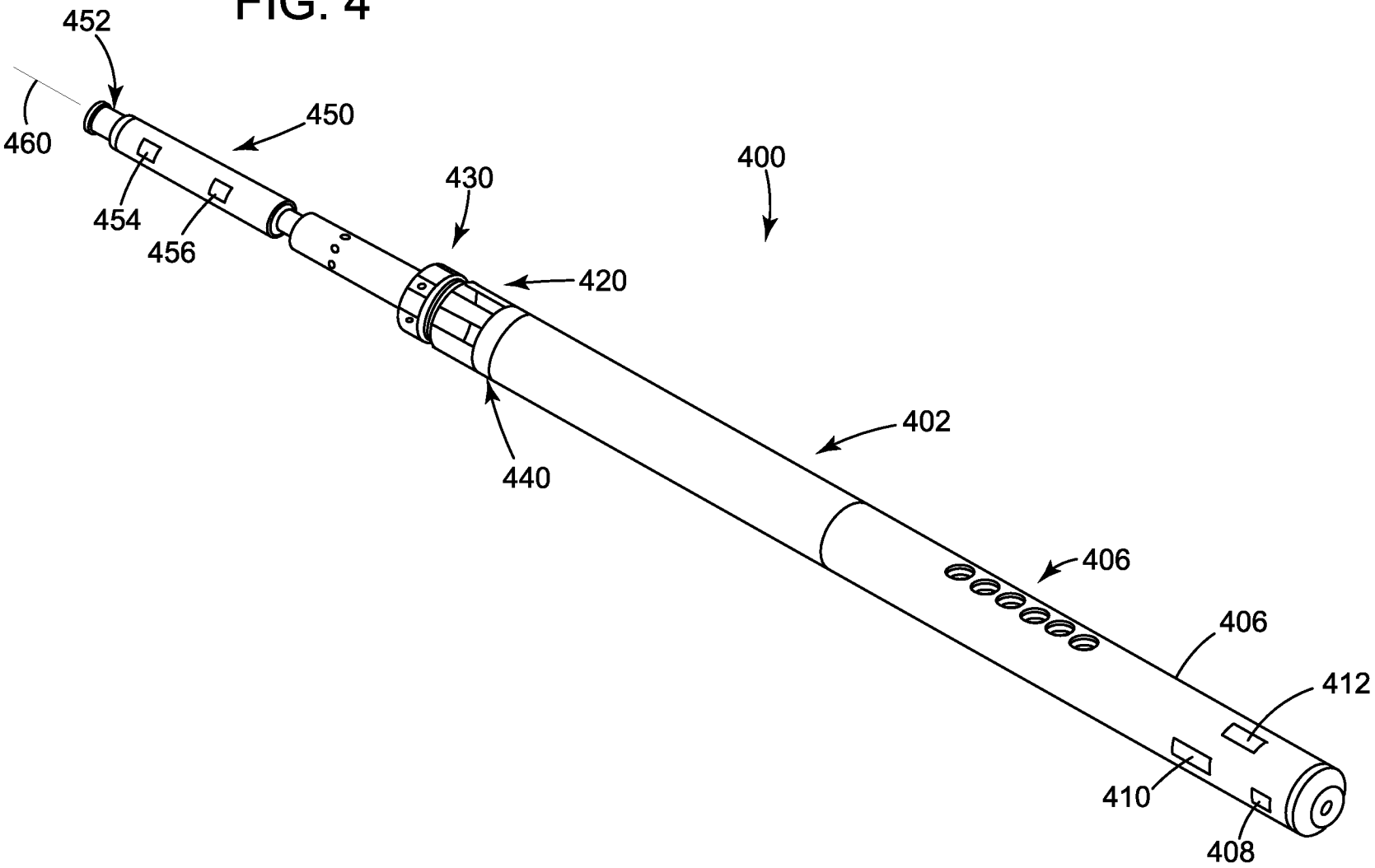
FIG. 4 illustrates a setting tool for opening the sleeve in the casing.
Figure 5A:
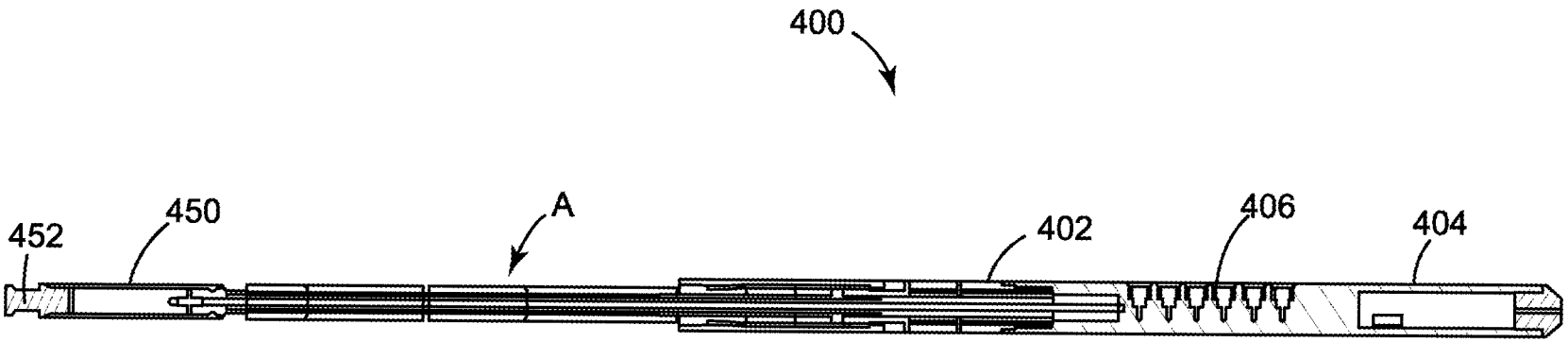
Figure 5B:
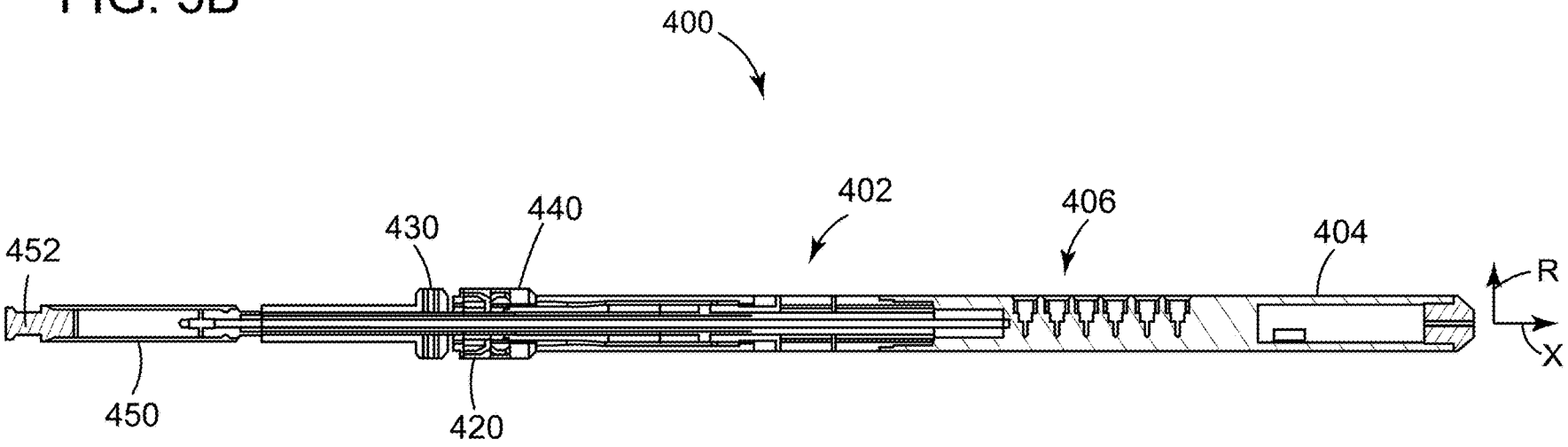
FIG. 5B illustrates the addition of these elements to the setting tool.

In one application, the setting tool shown in FIG. 4 may be used for different sized casing. For example, the casing may have an internal diameter of 4½" or 5½". Irrespective of the internal diameter of the casing, the setting tool shown in FIG. 4 may be provided with corresponding dogs and seals to account for the change in diameter of the casing. In this respect, FIG. 5A shows the location A of the setting tool 400 having no sets of dogs 420 or 430 and no seal 440. After determining the internal diameter of the casing in which the setting tool is to be deployed, the corresponding sets of dogs 420 and 430 and the seal 440 are added (slid from one end of the tool) to the body 402 of the setting tool, as illustrated in FIG. 5B.

Once the sets of dogs are in position, they are attached to corresponding pistons (to be discussed later) and can be moved relative to the body of the casing, both toward or away (i.e., radially) from a central longitudinal axis X of the body and also along the central longitudinal axis X. To move the dogs radially along axis X, ramps are sliding under the dogs and the ramps are powered by the pistons noted above. The pistons in turn are actuated with hydraulics, provided through the valves 406. In one application, instead of using hydraulics and solenoids for actuating the pistons, it is possible to use electrical motors with power screws. The hydraulics energy is supplied by the pressure established inside the casing. For this reason, the setting tool includes one or more accumulators (e.g., spring-loaded accumulators) that can store enough hydraulic energy to open and close several casing valve sleeves. The setting tool may use solenoid valves 406 for reducing the electrical energy required to open and close the valves. These pistons are shown and discussed in the next figures.

Figure 6:
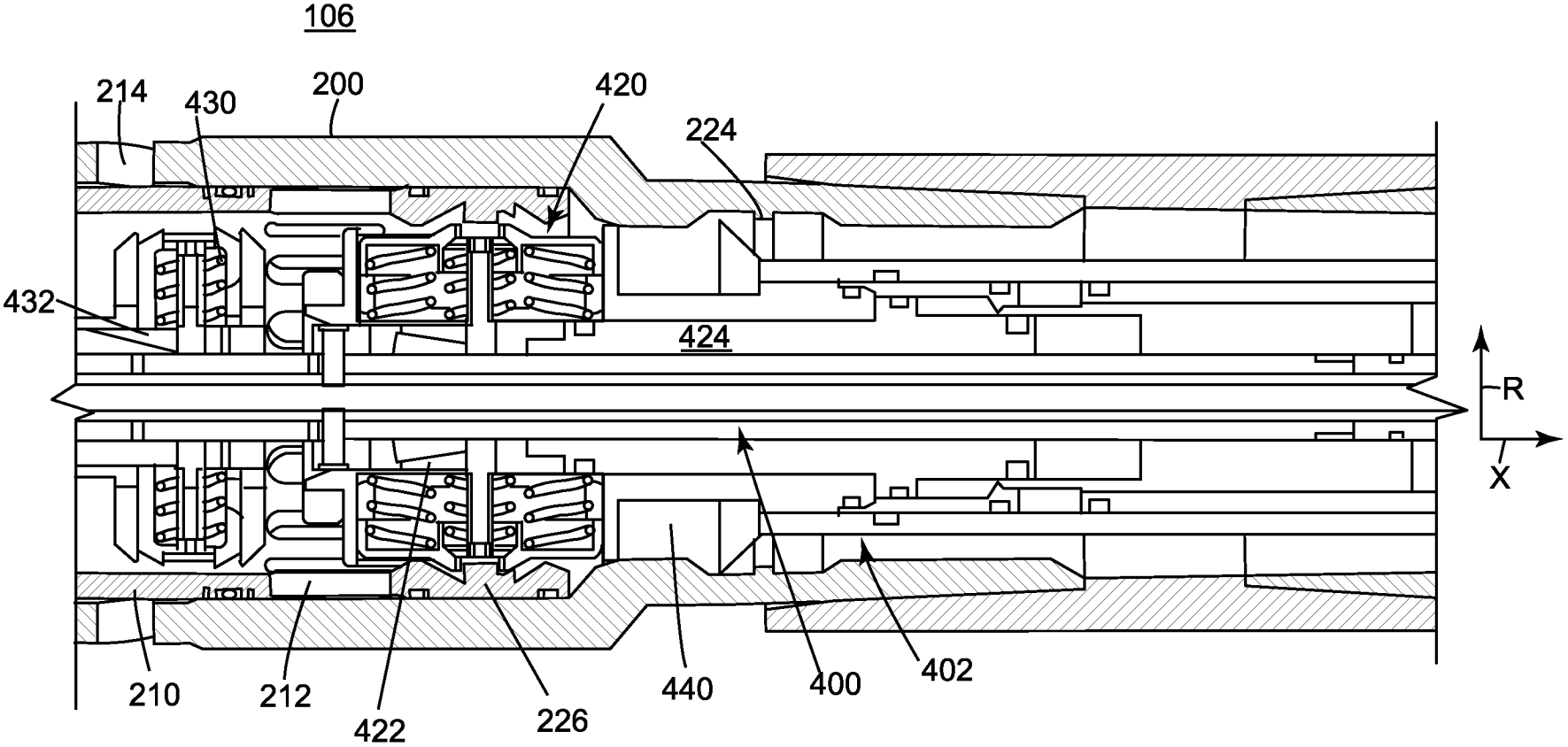
FIG. 6 illustrates the setting tool provided inside the casing.

FIG. 6 shows a casing 200 (considered to be the top casing in the casing string) having inside the setting tool 400. The holding dogs 420, the sleeve dogs 430 and seal 440 of the setting tool 400 are shown in cross-section. Also visible are the holding grooves 224 of the casing 200 and the sleeve grooves 226 of the sleeve 210. The aim of this embodiment is to connect the set of holding dogs 420 to the corresponding holding groove 224 to fix/hold the setting tool inside the casing 200, and then to connect the set of sleeve dogs 430 to the sleeve groove 226 to take control of the sleeve 210. In this way, the sleeve dogs 430 may be moved relative to the holding dogs 420 to open and close the sleeve 210 for fracturing the stage associated with the top most casing. After the fracturing operation is finalized, the sleeve 210 is closed and the sleeve dogs and holding dogs are disengaged from their respective grooves so that the setting tool 400 can move to the next casing to repeat the above operations and fracture the stage associated with the next casing. Because the sleeves of all the casings are closed except for the sleeve of the current casing in which the setting tool is deployed, the fracturing is controlled to take place only in the current stage.

FIG. 6 also shows holding dogs ramps 422 and sleeve dogs ramps 432. These ramps can move along the longitudinal direction X of the casing 200, to make the corresponding dogs to move along the radial direction R. Ramps 422 are actuated by piston 424 while ramps 432 are actuated by piston 434 (see FIG. 7). FIG. 6 also shows the sleeve 210 having plural sleeve openings 212 and the casing 200 having plural casing openings 214. Note that the two sets of openings are not aligned in FIG. 6, which means that the sleeve is closed and no fluid from inside the casing can fracture the formation 106 around the casing.

Figure 8:
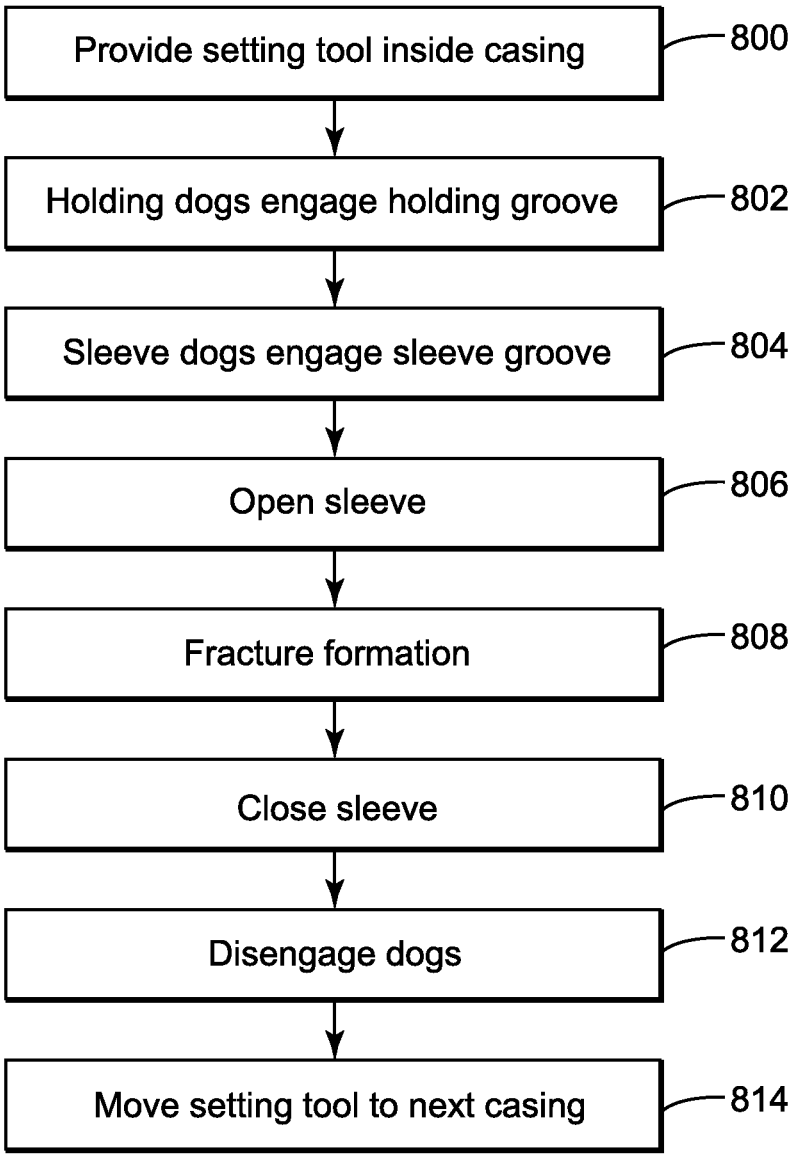
FIG. 8 is a flowchart of a method for opening the sleeve of the casing and fracturing a stage associated with the casing.

A method for moving the setting tool inside the casing, engaging the holding dogs followed by the sleeve dogs, and opening the sleeve of the casing for fracturing operations is now discussed with regard to FIG. 8. In step 800, the setting tool 400 is provided inside the casing 200, as illustrated in FIG. 6. The process starts with the top casing and then moves to the next casing, toward the bottom of the well, until all the casings are fractured. Those skilled in the art would understand that because of the autonomy of the setting tool, the operator can fracture selected stages, i.e., only selected casing valves can be opened for fracturing.

Figure 7:
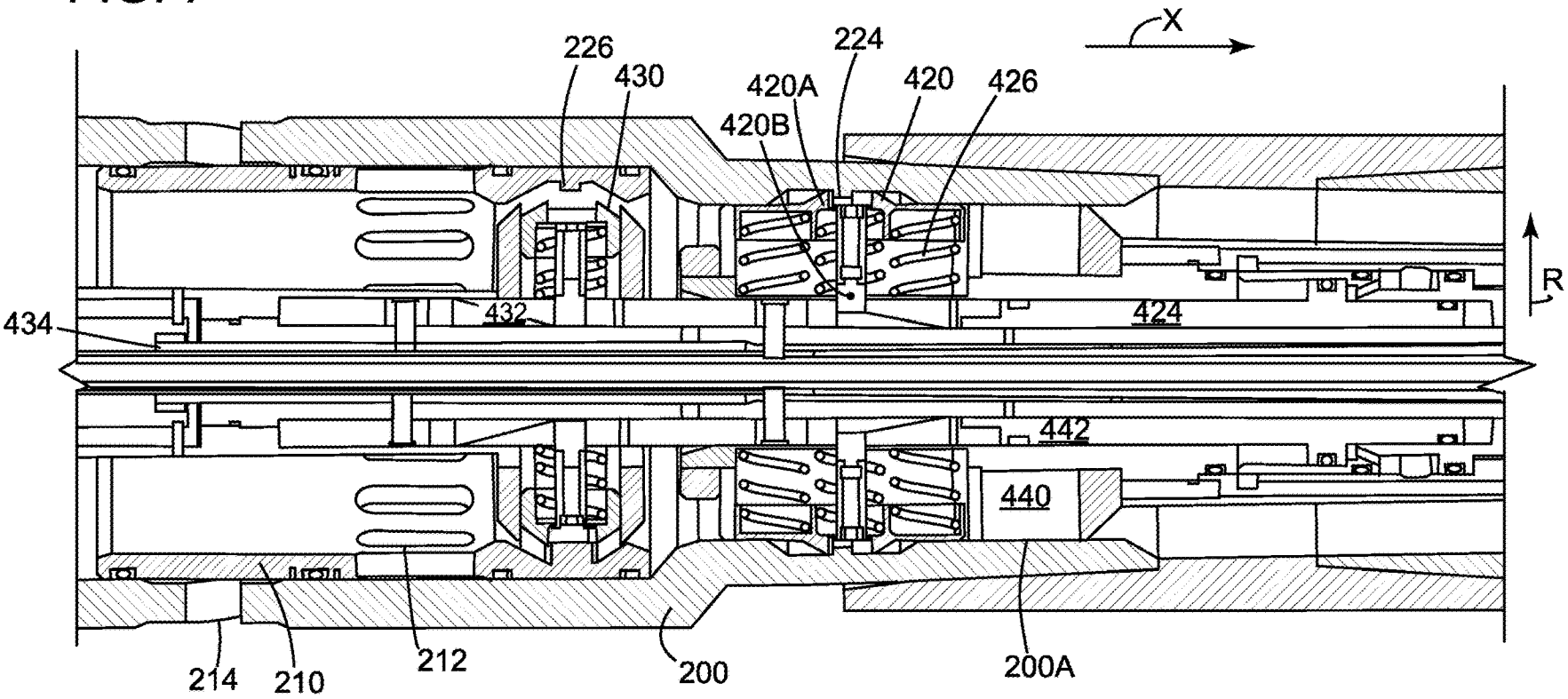
FIG. 7 illustrates the setting tool engaging the casing with the holding dogs.

In step 802, a top portion 420A (see FIG. 7) of the holding dogs 420 is engaged with the holding groove 224. This engagement takes place as the holding dogs 420 are biased by springs 426 (toward the central part of the setting tool along the radial direction) and because the holding ramp 422 was moved by the corresponding piston 424 to push the holding dogs along the radial direction R, toward the outside of the casing 200. In this regard, note that a bottom region 420B of the holding dogs 420 are located on top of ramp 422 in FIG. 7 while FIG. 6 shows the same bottom region of the holding dogs at the bottom of the ramp. Thus, the movement of the ramp 422 because of the piston 424 has pushed the holding dogs toward the interior wall of the casing 200 and when the top region 420A of the holding dogs 420 has met the corresponding holding groove 224, the two elements have locked in place as shown in FIG. 7. To prevent the top region 420A of the holding dogs 420 to engage with the sleeve groove 226 as the setting tool is travelling through the casing, a size of the sleeve groove 226 is larger than a size of the top region 420A so that the holding dogs 420 cannot engage with the sleeve groove 226. Note that at this time the sleeve 210 is still closing the casing openings 214. Also note that at this time the seal 440 is abutting tightly against the internal wall 200A of the casing 200, thus in effect isolating the stage corresponding to the current casing 200 from the rest of the stages associated with other casings.

The movement of the pistons is controlled by the processor 412, valves 406, and at least an accumulator that stores hydraulic energy as now discussed. When the setting tool is approaching the top most casing, the operator of the setting tool may send a signal along the wireline to the processor 412 for moving the holding dogs along the radial direction. Upon receiving this command, processor 412 opens one of the valves 406, which corresponds to piston 424, and allows the pressurized fluid inside the accumulator to move the piston along the longitudinal axis X, as illustrated by the corresponding arrow in FIG. 6, to move the ramp 422 under the holding dogs. As the setting tool is moving through the casing 200, the holding dogs 420 eventually engage the holding groove 226. At this time, the setting tool stops and the velocity sensors 456 determine that the setting tool has stopped. Processor 412 then choses valve 406 and may inform the operator of the well that the setting tool is set. When the setting tool is set, the pressure above it increases, which signals to the operator to stop pumping the setting tool.

Figure 9:
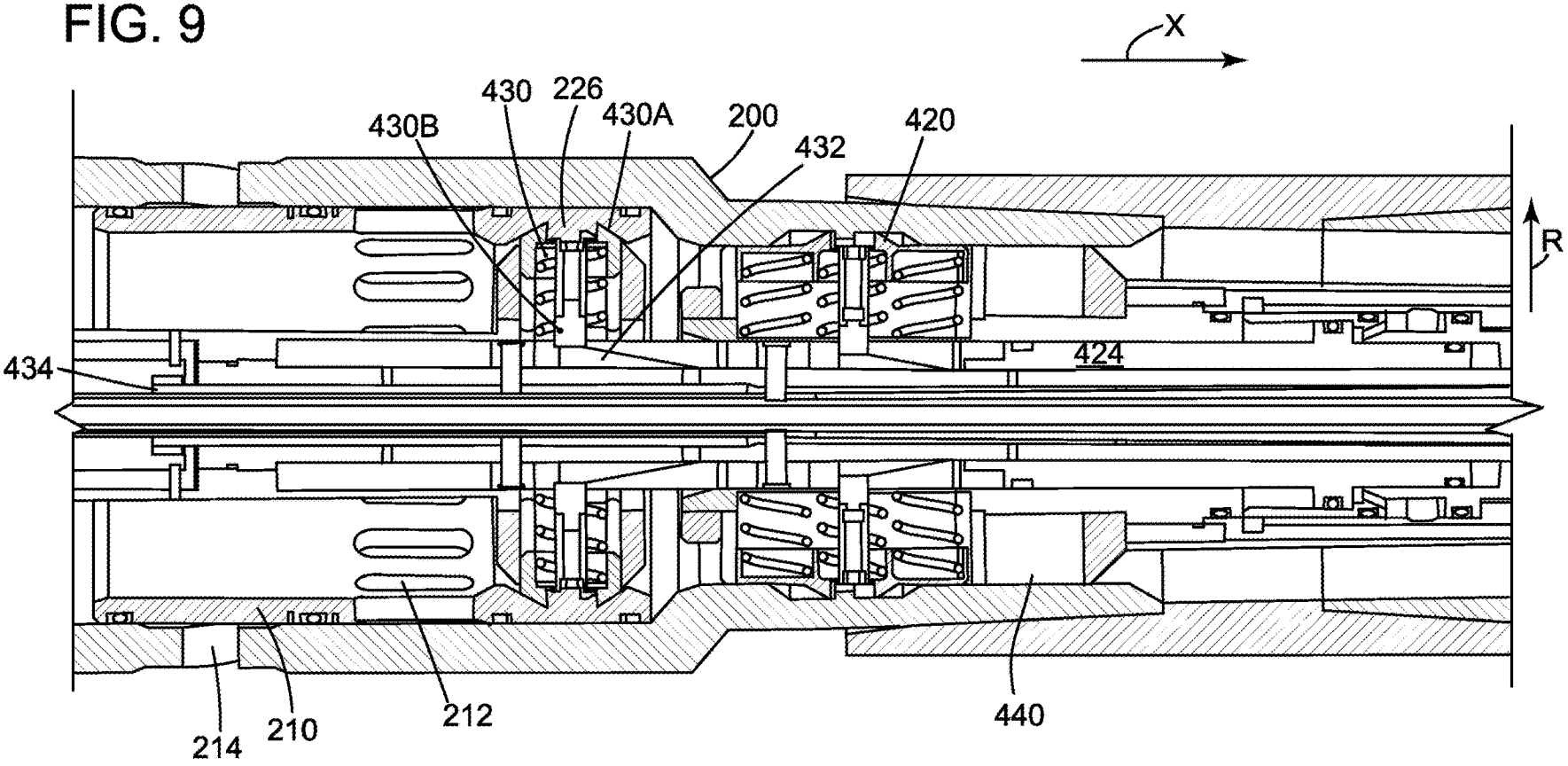
FIG. 9 illustrates the setting tool engaging the casing with the holding dogs and the sleeve dogs.

In step 804, the sleeve dogs 430 are engaged with the corresponding sleeve grooves 226. Because controller 412 has determined that the setting tool has stopped and knowing that the holding dogs are engaged, it can instruct the sleeve dogs 430 to engage the sleeve groove 226. In this regard, note that in FIG. 7 the ramp 432 is not biasing the sleeve dogs 430 along the radial direction. However, FIG. 9 shows the ramp 432 has moved along the longitudinal direction X due to piston 434 (which is controlled by processor 412 and corresponding valve 406), so that a top region 430A of the sleeve dogs 430 is engaged with the sleeve groove 226 and a bottom region 430B of sleeve dogs 430 has moved up the ramp 432. At this time, the holding dogs are holding the setting tool fixed relative to the casing and the sleeve dogs have engaged the sleeve and are ready to move the sleeve along the longitudinal axis X.

Figure 10:
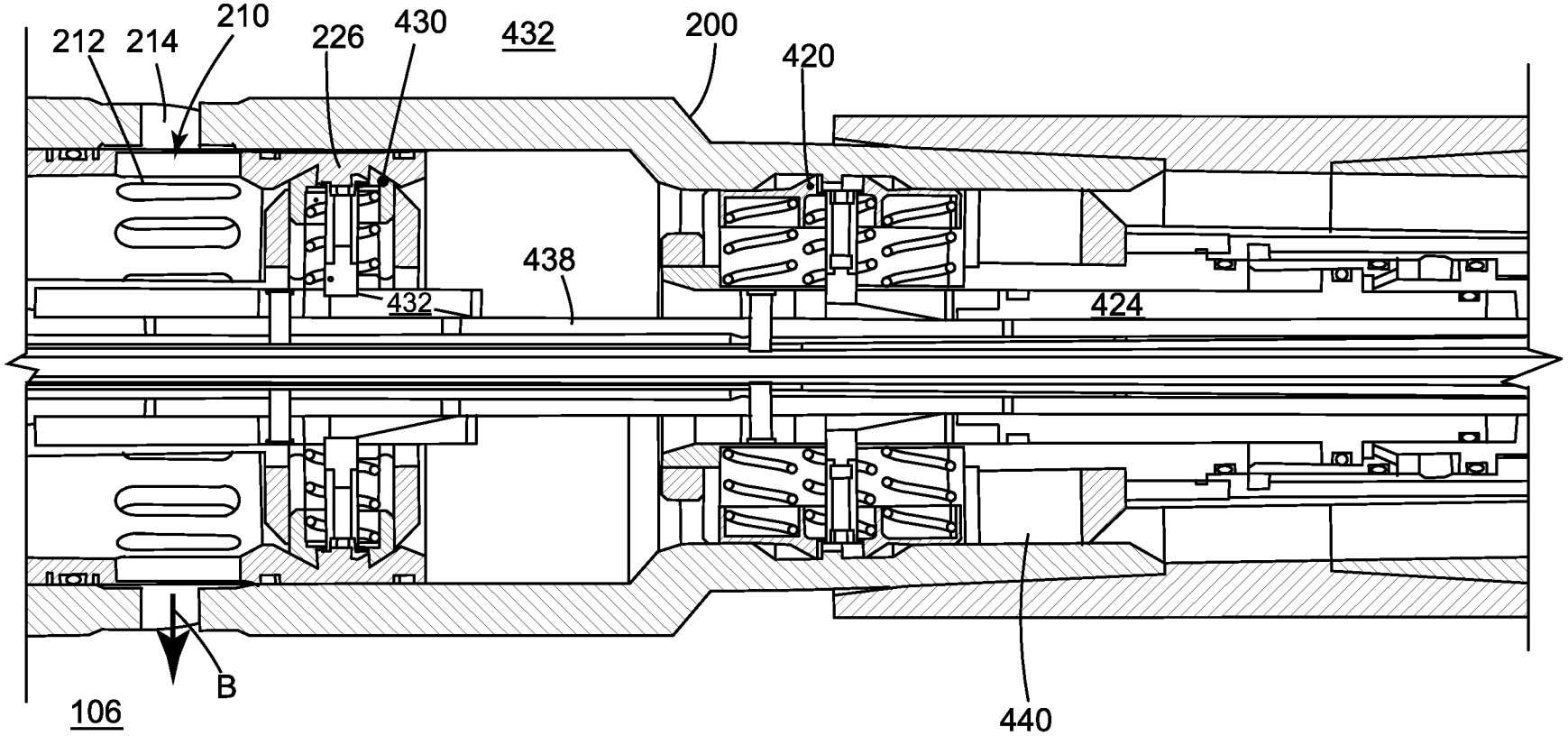
FIG. 10 illustrates the setting tool opening the sleeve.

In step 806, the sleeve 210 is opened as illustrated in FIG. 10. To move the sleeve dogs 430, another piston 438 (a second piston) is used. This second piston 438 is associated with the sleeve dogs 430 and moves not only the sleeve dogs as illustrated in FIG. 10, but also the ramp 432. Due to the movement of the sleeve dogs 430 relative to the holding dogs 430 and implicitly relative to the casing 200, the sleeve 210 moves along the longitudinal axis X, toward the left in the figure, so that the sleeve openings 212 become aligned with the casing openings 214. The movement of the second piston 438 is coordinated by controller 412 and achieved by corresponding hydraulic valve 406.

In step 808, the fracturing fluid is pumped from the casing and exits through aligned openings 212 and 214 into the formation 106, as indicated by arrow B in FIG. 10. Note that due to the seal 440, which abuts against the internal wall of the casing 200, no sand or other formation debris from the formation passes the seal toward the other casing valves. Thus, the setting tool can freely move toward the other casing valves after finalizing the fracturing of the current stage.

When the fracturing operation is concluded for the current stage, the sleeve 210 needs to be moved back to the closed position, to close the sleeve openings 212. Thus, in step 810, the sleeve is closed. To instruct the controller 412 to close the sleeve, the following mechanism may be used. Suppose that the operator of the well has finalized the fracturing operation. The operator may send a signal to the controller 412 for closing the sleeve. The signal may be transmitted in various ways, i.e., as an electrical signal along a wire, as an acoustic signal with a modem, etc. The embodiment presented in FIG. 10 uses the following mechanism. The well is allowed to flow-back (i.e., the fluids inside the well flow toward the surface) after the fracturing operation. The flow-back is stopped (usually by using pumps at the surface) and then the fluid is flown into the well. This pattern of flowing the fluid in one direction, stopping the flow, and the flowing the fluid in the opposite direction can be identified by the controller 412 by using the velocity sensor 456. In one application, the pattern includes flowing 5 barrels back (i.e., out of the well), waiting for 2 minutes, and then pumping 5 barrels back into the well. Other quantities and times may be used. When this "finished pattern" is identified, the controller 412 knows that the fracturing process is finished and needs to close the sleeve.

Figure 11:
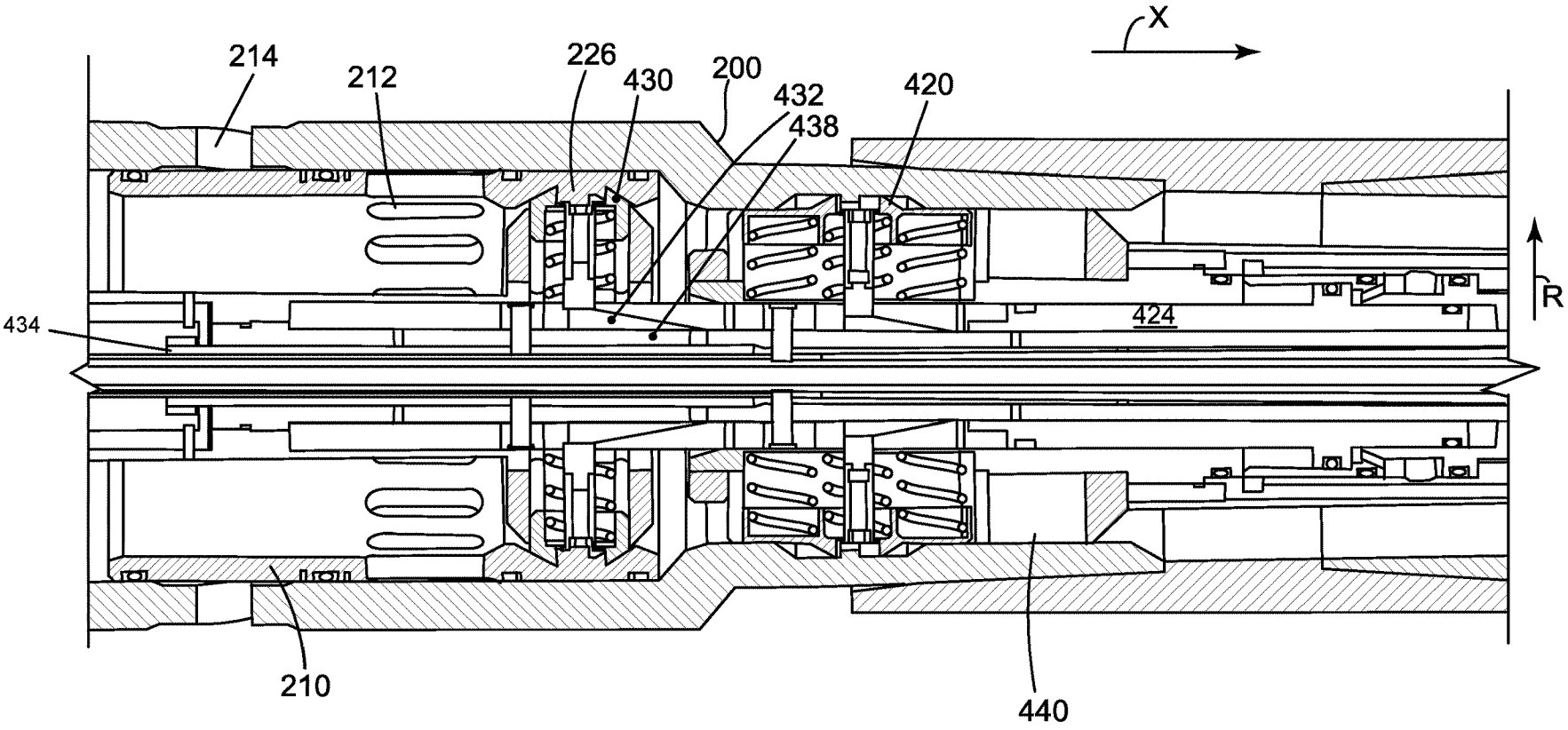
FIG. 11 illustrates the setting tool closing the sleeve.

The controller 412 connects another valve 406 to the hydraulic pressure in the accumulator so that the second piston 438 moves in the opposite direction relative to the configuration shown in FIG. 10. FIG. 11 shows the second piston 438 taking the sleeve dogs 430 and the sleeve 210 back to the closed position as in FIG. 9. Note that during the opening and the closing of the sleeve, the holding dogs 420 and the seal 440 do not move along the longitudinal axis X or along the radial axis R.

Figure 12:
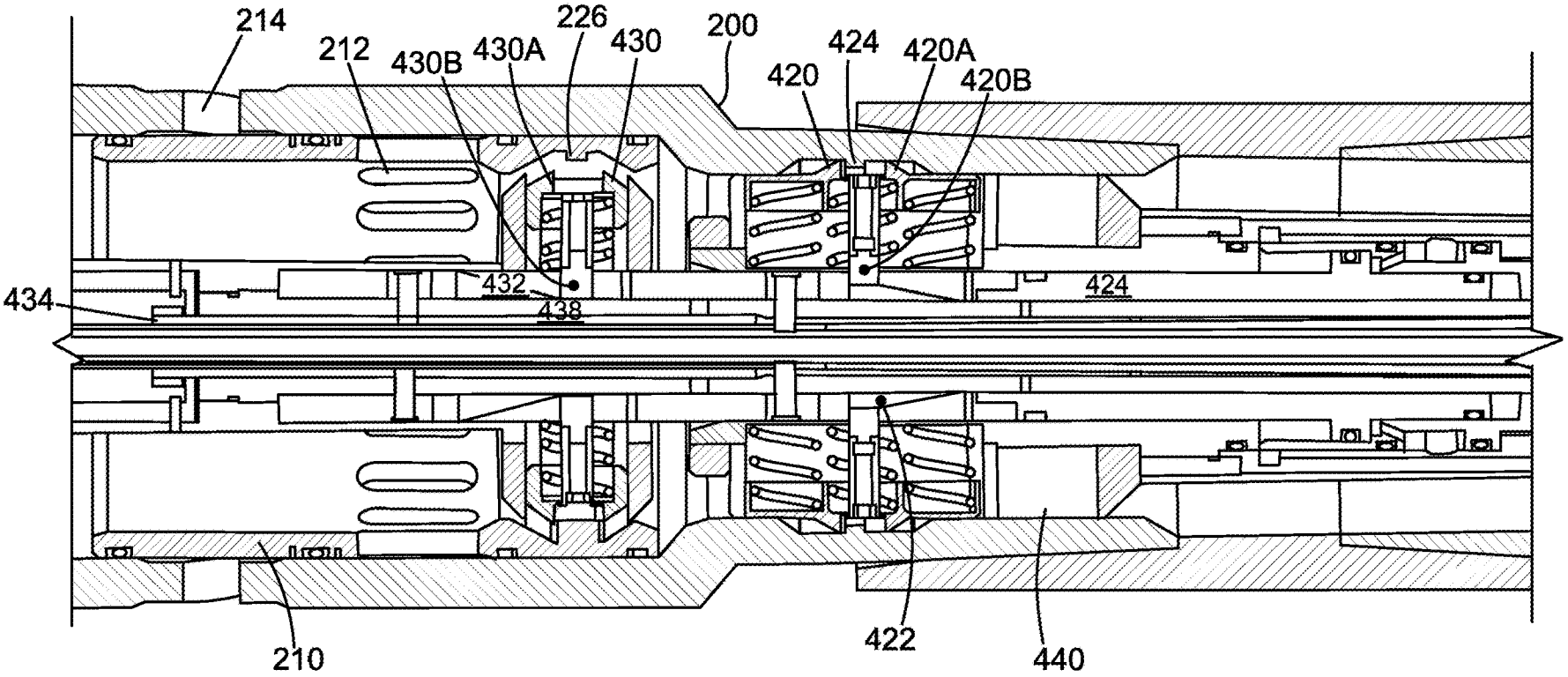
FIG. 12 illustrates the setting tool disengaging the casing.

After the sleeve 210 has been closed, it is time to move the setting tool to the next casing. To achieve this objective, the holding dogs 420 and the sleeve dogs 430 are disengaged in step 812 (or closed, i.e., retracted along the radial axis R toward the center axis of the setting tool), as illustrated in FIG. 12. The dogs are disengaged from their connections with the corresponding grooves in the casing by moving the sleeve ramps 432 with the piston 434 and the holding ramps 422 with the piston 424. In this regard, note that FIG. 12 shows the bottom regions 420B and 430B of the holding dogs 420 and the sleeve dogs 430, respectively, to be at the bottom of their respective ramps. FIG. 12 also shows the top regions 420A and 430A of the holding dogs 420 and the sleeve dogs 430, respectively, disengaged from the corresponding grooves 224 and 226. The controller 412 can be programmed to perform these operations sequentially, with a given wait time between two subsequent operations.

In step 814, the operator pumps the setting tool 400 downward toward the next casing. The setting tool monitors its movement with its velocity sensor 456 (e.g., the velocity sensor may include one or more accelerometers). After a given distance D, which is calculated to be less than a distance from the openings 212 of one casing to the openings of an adjacent casing, the controller 412 is configured to open the holding dogs (i.e., to move the corresponding rams) so that the holding dogs catch and engage the holding groove of the next casing. This means that the process disclosed in FIG. 8 returns to step 802 and performs all the steps discussed above for the next casing. This process continues until each casing has been opened, fractured and then closed. At the end of this process, all the stages have been fractured and all the valves are closed. As previously discussed, the operator may select to not open each casing.

The setting tool needs now to be retrieved to the surface. For this action, a retrieval tool is sent in the well. The retrieval tool is configured to latch onto the fishing neck 452 of the setting tool 400. The retrieval tool may be attached to the wireline (or another line, e.g., slickline) to be lowered into the well. Once the retrieval tool latches on the fishing neck 452, the wireline is pulled up to bring to the surface the setting tool. The controller 412 of the setting tool, based on measurements received from the velocity sensor, determines that the setting tool is moving toward the surface and can instruct the valves 406 to actuate the corresponding pistons to make sure that the dogs sit at the bottom of the corresponding ramps, so that neither the holding dogs nor the sleeve dogs engage a corresponding groove in the interior wall of the casings.

Figure 13:
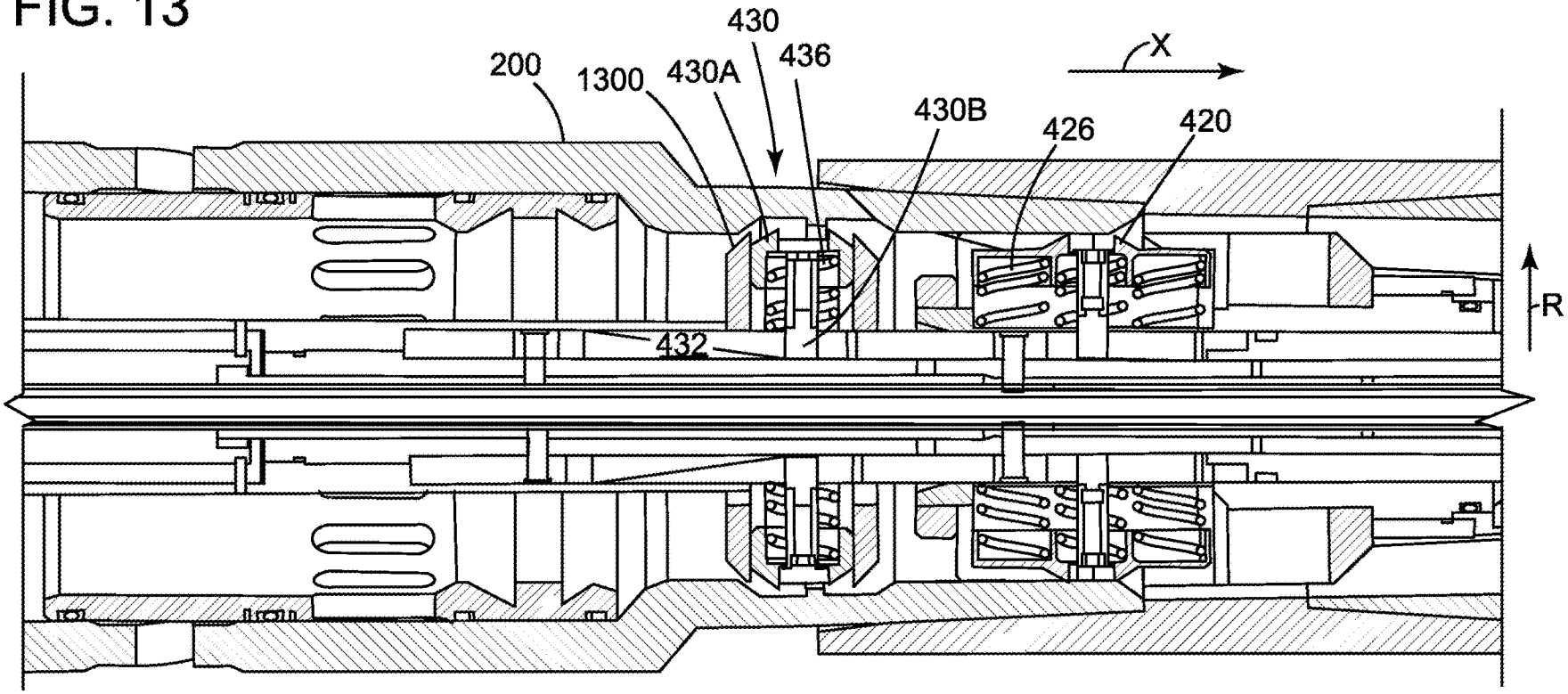
FIG. 13 illustrates the setting tool moving to the next casing.

In one embodiment, as shown in FIG. 13, is it noted that sleeve dogs 430 have the top portion 430A moving up and down along the radial direction R as previously discussed. The top portion 430A is biased by a spring 436. However, when the corresponding ramp 432 is moved under the base portion 430B, top portion 430A moves in tandem with the base portion 430B upwards. A protection region 1300 is formed around the top portion 430A. The protection region 1300 is designed to not engage any groove in the interior wall of the casing when the setting tool moves through the setting tool. FIG. 13 shows that the top region 430A fits inside the protection region 1300 when the ramp 432 is not pushing radially the base portion 430B. The same structure may be employed for the holding dogs 420. Holding dogs 420 may have plural springs 426. In one application, the holding dogs and/or the sleeve dogs have multiple elements that "bite" into the corresponding groove formed in the interior wall of the casing. The figures discussed until now show a holding or sleeve dog at the top the figure and one at the bottom. Those skilled in the art would understand that other elements similar to those shown in the figures may be added all around the longitudinal axis X of the setting tool to better engage the casing and/or the sleeve.

In one embodiment, the setting tool may be used to open the sleeve of each casing valve while the setting tool moves from the bottom of the well toward the top so that well production can commence. For this situation, the holding dogs are open, i.e., the corresponding ramp is moved under the dogs to push them outward along the radial direction. The setting tool is moved upward with the wireline until the holding dogs engage a corresponding groove in a casing. The velocity sensors of the setting tool determine that the setting tool has stopped. The controller of the setting tool then instructs the sleeve dogs to engage the sleeve groove of the casing and open the sleeve. The casing sleeve is opened. Then all the dogs are disengaged and the setting tool can move upwards towards the next casing.

Figure 14:
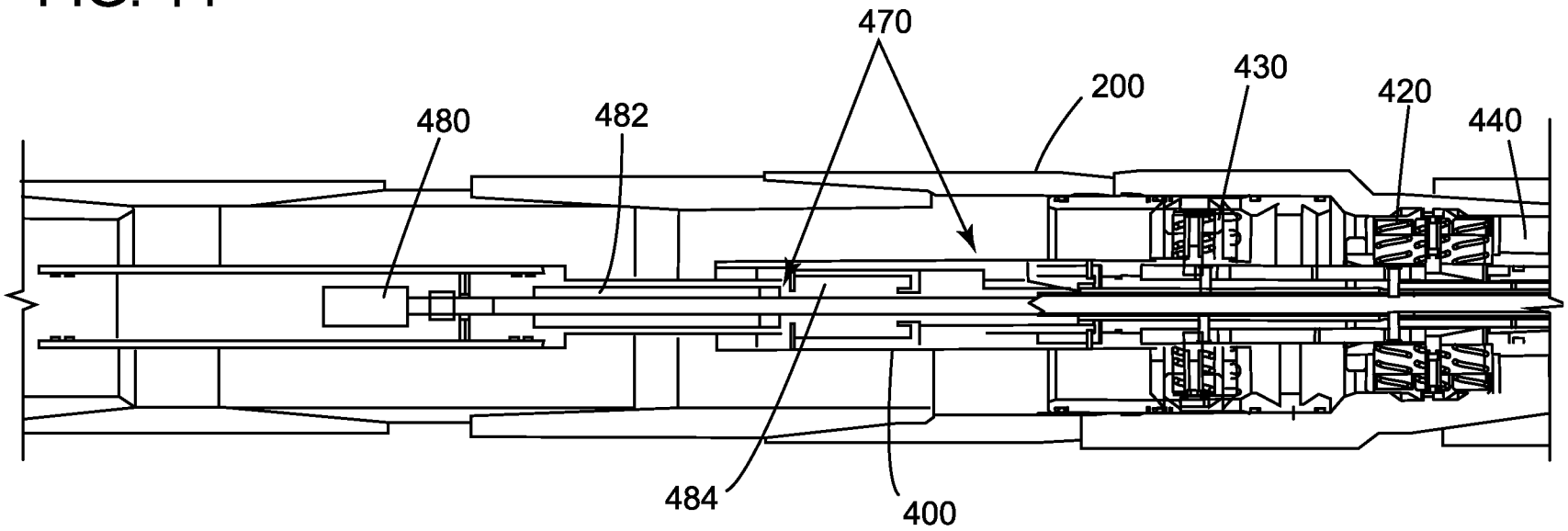
FIG. 14 illustrates an accumulator and fail safe mechanism of the setting tool.

In one embodiment, it is possible that the setting tool gets stuck in a casing. In this situation, as shown in FIG. 14, the wireline or slickline is pulled with an increased force to shear pins 470, which make the ramps 422 and 432 to move away from the base portions of the dogs, so that the dogs move toward the central part of the setting tool under their bias generated by the springs 426 and 436, and thus, the setting tool is free to move inside the casing. The wireline is then used to pull the setting tool out of the casing string. FIG. 14 also shows possible accumulators 480, 482 and 484 for storing the hydraulic energy. In one application, chambers 482 and 484 are used for moving the pistons discussed above along a desired direction.

Figure 15:
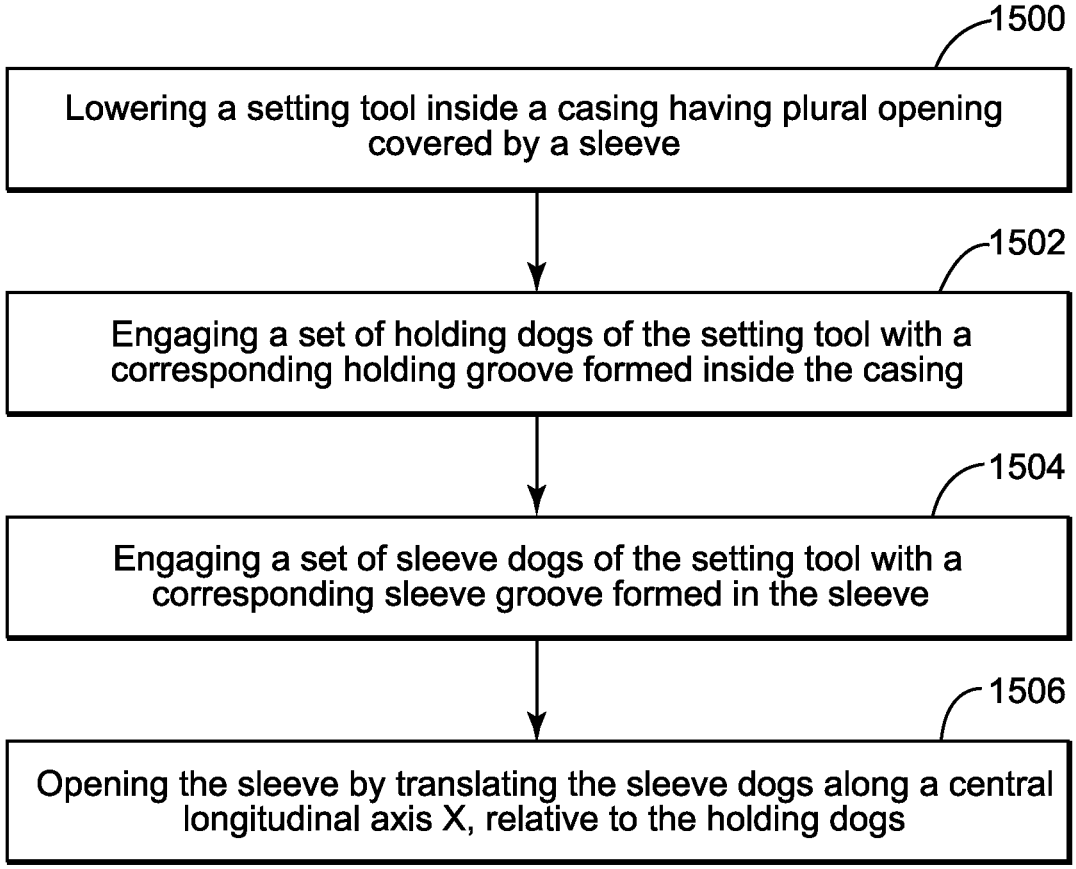
FIG. 15 is a flowchart of a method for opening the sleeve of the casing.

A method for opening a sleeve of a casing and then fracturing a stage associated with the casing is now discussed with regard to FIG. 15. The method includes a step 1500 of lowering a setting tool 400 inside a casing 200 having plural openings 212 covered by a sleeve 210, a step 1502 of engaging a set of holding dogs 420 of the setting tool 400 with a corresponding holding groove 224 formed inside the casing 200, a step 1504 of engaging a set of sleeve dogs 430 of the setting tool 400 with a corresponding sleeve groove 226 formed in the sleeve 210, and a step 1506 of opening the sleeve 210 by translating the sleeve dogs 430 along a central longitudinal axis X, relative to the holding dogs 420. The method may further include one or more of the step of fracturing a formation around the casing by pumping a fluid into the casing, the step of closing the sleeve by translating back the sleeve dogs along the central longitudinal axis X, relative to the holding dogs, the step of disengaging the holding dogs and the sleeve dogs from their respective grooves, and the step of pumping the setting tool further down the well to the next casing. In one application, the step of opening includes a step of activating a sleeve piston for translating the sleeve dogs along the central longitudinal axis, a step of releasing from an accumulator a fluid under pressure for activating the sleeve piston and/or a step of recharging the accumulator by pumping the fluid into the well with a pump at a surface of the well.

Figure 16A:
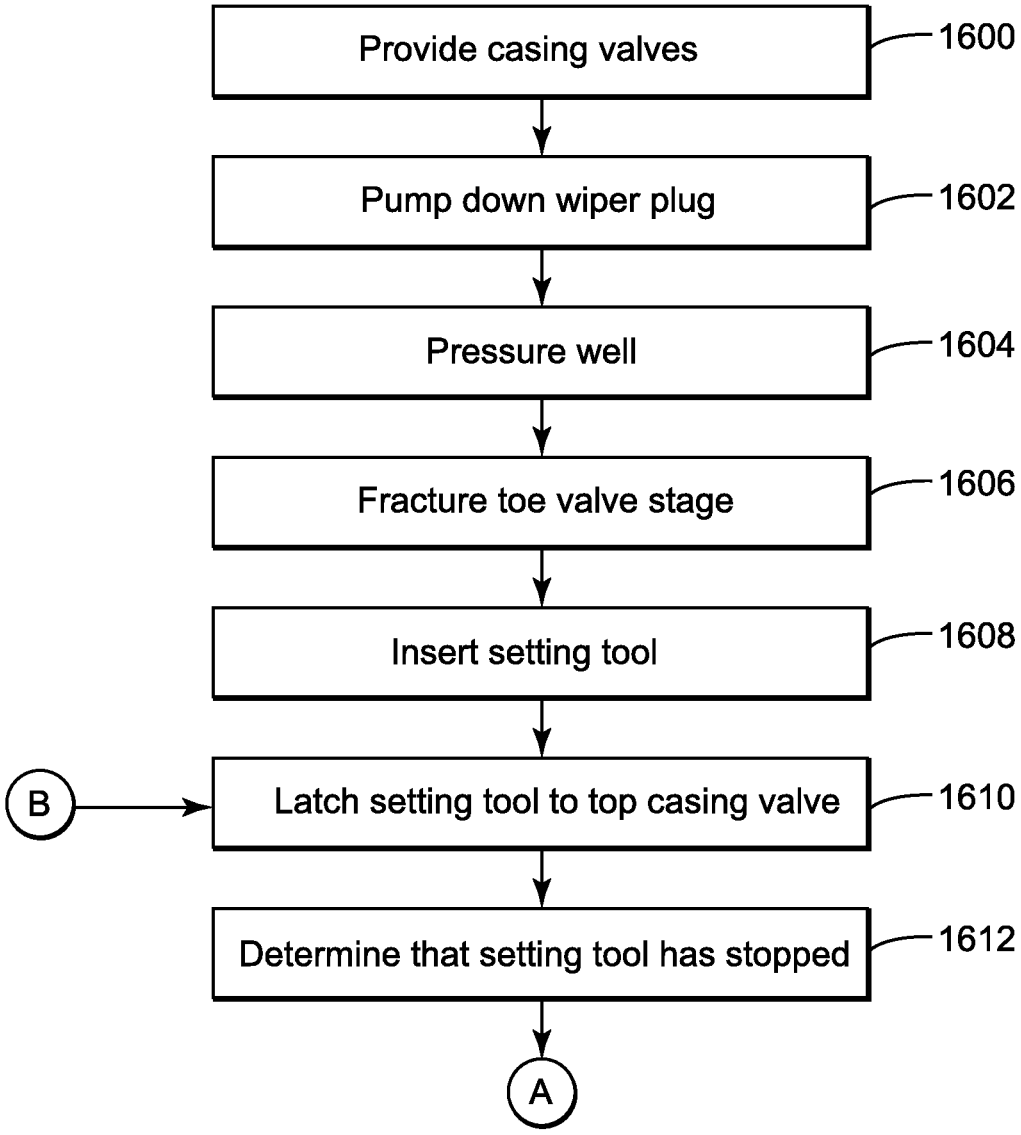
FIGS. 16A to 16C illustrate a flowchart of a method for opening the sleeve, fracturing the stage associated with a casing, closing the sleeve and then repeating this operation for all the casings in the casing string.
Figure 16B:
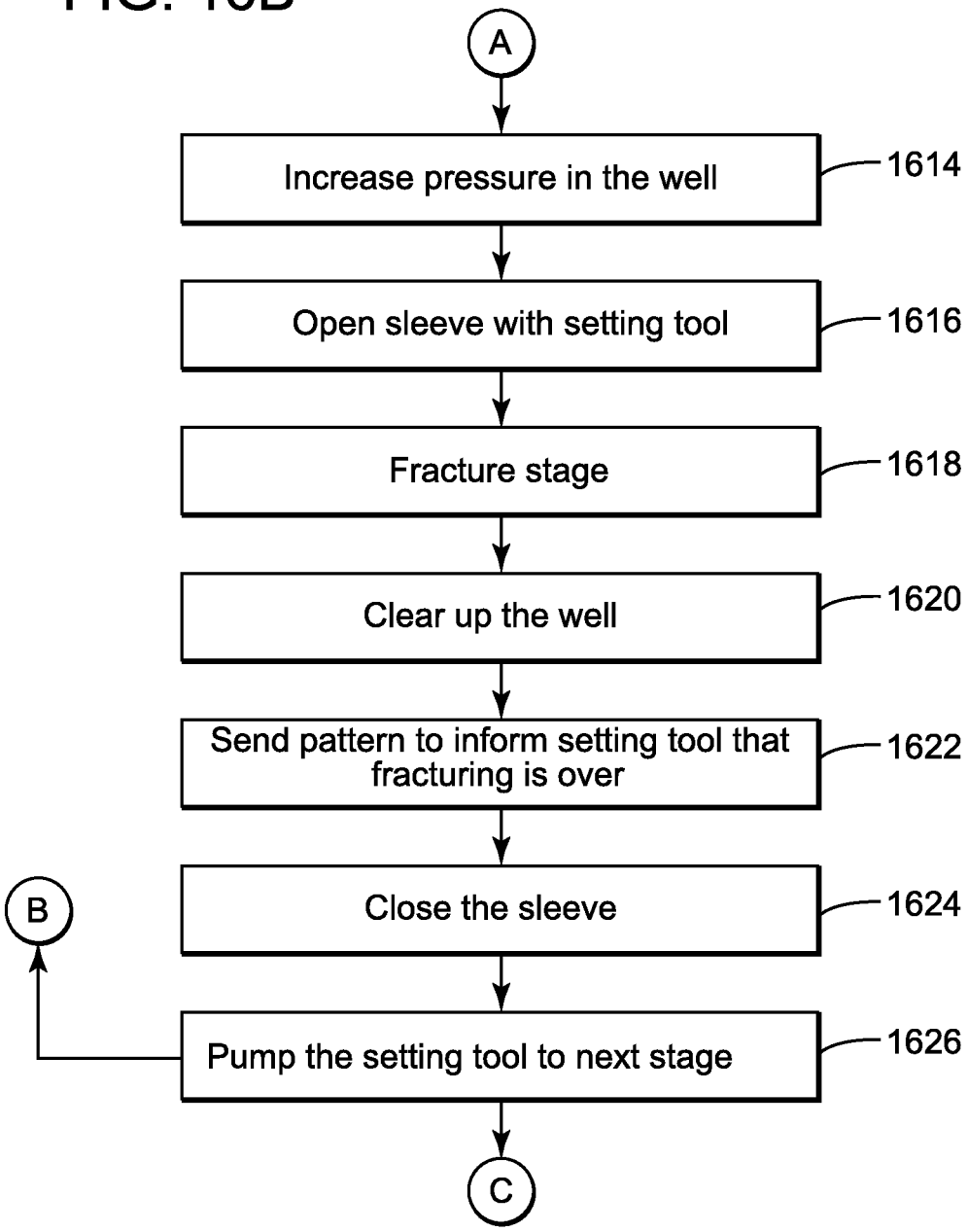
Figure 16C:
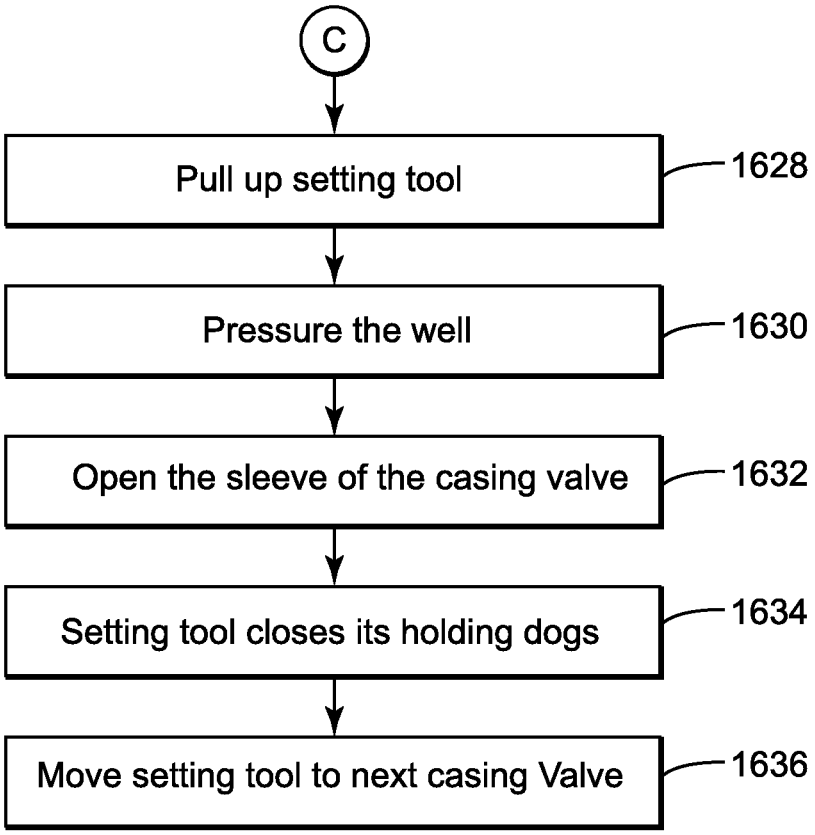

Another method for fracturing a well, with the setting tool discussed in the previous embodiments, is now discussed with regard to FIGS. 16A to 16C. The method includes a step 1600 of providing multiple casing valves in a casing string, the casing string having a toe valve at the bottom. The casing valves do not need to have burst discs or any type of time delay, but each casing has latching profiles and a sliding sleeve as illustrated in the previous figures.

In step 1602, the wiper plug is pumped down. When the wiper plug bottoms-out, the operator of the well will note a pressure spike at the surface. Then, in step 1604, the well is pressured up to test the casing string. If the pressure holds, then the operator applies more pressure to rupture the burst disk in the toe valve. At this time, the openings in the toe valve are opened and in step 1606, the stage associated with the toe valve is fractured. After the fracturing of this stage is completed, the well may be cleaned.

In step 1608, the setting tool 400 is inserted into the well and pumped down. Because the setting tool is moving only in water, there is less chance of getting stuck in the casing. The setting tool has a pressure transducer and a fluid velocity sensor at least at the top of the body. The setting tool has holding dogs that are spring-loaded open. However, they default to closed if there is a loss of power. The setting tool has a spring-loaded accumulator 480 with enough hydraulic energy to open and close several casing valve sleeves. The setting tool may use solenoid valves 406 to reduce the electrical energy required to activate the dogs. The accumulator 480 stores fluid under pressure and is configured to actuate a holding piston, a first sleeve piston and a second sleeve piston for moving the set of holding dogs and the set of sleeve dogs. In one application, the holding piston, the first sleeve piston and the second sleeve piston are concentric to each other.

The spring-loaded holding dogs latch in step 1610 into a profile (e.g., holding groove) in the first casing valve near its heel and holds the setting tool in position with its seal 440 under the casing valve. The well is now plugged and the operator of the well notices a pressure spike at this point.

In step 1612, the setting tool knows it stopped (because of the measurement received from the velocity sensor and/or pressure transducer) and is in position. In step 1614, the operator increases the casing's pressure to re-charge the hydraulics (e.g., accumulator 480) in the setting tool 400. In step 1616, the setting tool uses its stored energy to open the sleeve dogs and to open the casing valve's sleeve. Once the sleeve is open, the upper-most stage is fractured in step 1618. In step 1620, if the well sands out, the operator can cycle the flow to clear it up, because the setting tool is held below the flow, and not in the sand.

After finishing the fracturing operation, the operator sends in step 1622 a stop and start fluid flow pattern so that the setting tool recognizes as the "Finished Frac-ing Pattern" signal indicating that the fracturing operation has been concluded (if no signal is received, it times out based on a timer started by the controller 412). The setting tool closes in step 1624 the casing valve's sleeve, the setting tool's sleeve dogs, and then closes the setting tool's holding dogs. In step 1626, the operator pumps the setting tool to the next casing valve, still moving in water only. Next, the setting tool spring-opens the holding dogs and latch onto the next casing valve (i.e., repeats step 1610), and seals. The process repeats now the steps 1612 to 1626 of holding in position with the seal, pressurizing the casing to charge the setting tool, opening the sleeve, fracturing the current stage, closing the sleeve, closing the holding dogs, moving the setting tool to the next casing valve, spring-opening the holding dogs, latching to the next casing valve and so on.

When this process is completed, all of the stages are fractured and their sleeves are re-closed. The retrieval tool is pumped down in step 1628, on a Slickline, or a Wireline and latched onto the setting tool. The setting tool would be chased down to the toe valve. However, the fluid flow is allowed to go around the setting tool. The setting tool's holding dogs are still sprung open. The setting tool is pulled up the casing spring in step 1628 until the holding dogs latch to the lowermost casing valve. The well is again plugged. In step 1630, the operator pressures the well to charge the accumulator of the setting tool. In step 1632, the setting tool opens the casing valve's sleeve so that oil and/or gas from the formation can enter the casing. In step 1634 the setting tool closes its holding dogs and the setting tool is pulled up in step 1636 toward the next casing valve and the previous steps are repeated to open the next sleeve. In this way all the sleeves are open and the exploration of the well can commence as the oil and/or gas is now flowing through the openings into the well.

The method discussed above may be modified as now discussed. In one embodiment, instead of pumping the retrieval tool to the bottom of the well to hook it to the setting tool, the setting tool can be moved up-hole by using the flow-back of each of the stages. When the setting tool finishes opening the last casing valve, it closes its holding dogs and then can flow-back the well. The setting tool moves up toward the next casing valve. As the setting tool arrives at the next casing valve, the setting tool spring-opens the dogs and latches onto the next casing valve. Then, the setting tool opens the sleeve, and the operator pressures up the formation and the setting tool. Next, the setting tool closes the holding dogs and flows-back the well so that the setting tool moves upward. This process continues until the setting tool arrives at the last casing valve near the heel. After opening the last sleeve, the setting tool is kept latched to the casing valve and the retrieval tool is pumped in the vertical section of the well. After the retrieval tool is connected to the setting tool, the holding dogs of the setting tool are released from the groove of the casing, and both tools are retrieved from the well. Those skilled in the art would be able, having the benefit of this disclosure, to practice different variations of the methods discussed herein. Note that while the above embodiments have discussed using a wireline to convey the setting tool inside the well (or at least to retrieve the setting tool), it is possible to have the setting tool move autonomously inside the well, or to be attached at the end of a slickline or wire rope, or wireline, or coiled tubing or coiled tubing with wireline inside.

The setting tool discussed above may have the hydraulics implemented with solenoids for powering the holding dogs open and closed, and open and close the casing valve's sleeve. The holding dogs are configured to "Fail safe" in the closed position. The controller and sensors may be selected to work with "AA" lithium batteries. Thus, no high power electrical devices are used except for the solenoids. In one application, the setting tool would carry enough batteries for a 100 casing valve stages per run. In another application, the setting tool could carry enough batteries to complete the entire job, so that recharging is not required.

During pressurizing the casing, the upper pressure may move a piston in the setting tool that has check valves. This "pump" mechanism re-charges the hydraulic accumulator during every pressurization cycle.

"Time Based," "Velocity Pattern Recognition," or "Pressure Pattern Recognition" signals based communication is possible between the operator of the well and the controller of the setting tool. These types of communication are enhanced by the presence of the pressure transducers, fluid velocity sensor, and accelerometer. In one application, the setting tool may have an information storing device (e.g., a memory) for post-job analysis (as an example, it will know if all the sleeves were opened).

The setting tool may act as a moving, resettable plug, rated at 10,000 psi differential pressure, with dogs that open and close the casing valve's sleeves. In one application, the setting tool may be designed to have the upper section made of materials that are acid resistant. The setting tool may be designed for multiple jobs, with minimal maintenance.

One or more advantages of the setting tool discussed above are as follows:

pin point frac-ing performed at each stage;
no debris in the well due to the seal 440;
no dissolving balls are needed;
no drilling out of various plugs between the stages is required;
no waiting for activation;
need not Frac all of the casing valve stages;
for an autonomous tool, pre-program the setting tool to skip some casing valves, or use simple down-link communication (pressure and fluid velocity);
any of the stages can be fractured with another future run with the setting tool;
no coiled tubing frac-ing;
the setting tool could be conveyed on slickline, wireline, coiled tubing, or drill pipe;
the sleeves can be individually re-opened or re-closed with future runs;
the sleeves can be partially opened;
selected sleeve can be open or closed;
with a setting tool memory, a record is keep of when each sleeve was moved;
if a wireline is conveyed, the setting tool can contain a pump to charge its hydraulic system, and have real time data acquisition of pressure and velocity downhole while fracing;
less water usage than a conventional fracturing operation;
no explosives are used during the fracturing;
the casing valves are 11" shorter and have a smaller outer diameter (e.g., 6.50") than current FracBack design;
the casing valves have no deforming seat, no locking ring, no collet, no balls, no darts, nor any outer burst disk cover;
enough batteries can be carried for over a hundred stages;
the setting tool is reusable while the conventional guns are not;
the setting tool may include communication capability while the conventional guns do not;
the same setting tool may be used for different size casings;
the setting tool may have the wear items (seals and dogs) easily replaced for multiple usage;
the parts exposed to corrosion can be made of acid resistant materials;
the structure of the casing valve being simple, its price is low;
the setting tool requires less surface equipment for its usage;
no conveyance equipment in the casing during Frac-ing;
faster setup that conventional fracturing operations;
the memory record the pressures;
depth knowledge; and
can monitor down-hole pressure in real-time.

The disclosed embodiments provide methods and systems for selectively actuating one or more casing valves in a casing string. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A setting tool for opening and closing a sleeve inside a casing, the setting tool comprising:

a body extending along a central longitudinal axis X;
a set of holding dogs located around the body;
a set of sleeve dogs located around the body;
a valve block connected to an end of the body and having plural hydraulic valves, the plural hydraulic valves being configured to allow a fluid under pressure, in and out of the body, to actuate the set of sleeve dogs;
a seal located on an outside of the body, and configured to face the casing, to fluidly insulate the sets of holding dogs and sleeve dogs from the valve block so that the fluid under pressure enters through the valve block to actuate the set of sleeve dogs;
a controller located inside the body; and
a sensor located on the body and configured to measure a speed of the body relative to the casing,
wherein the set of sleeve dogs are configured to move along the central longitudinal axis X relative to the set of holding dogs when the controller determines, based on an input from the sensor, that the body is at rest relative to the casing.

2. The setting tool of claim 1, further comprising:

a holding ramp configured to slide under the set of holding dogs to move the holding dogs radially away from the central longitudinal axis, a holding piston located inside the body and configured to move the holding ramp along the central longitudinal axis, and a sleeve ramp configured to slide under the set of sleeve dogs to move the sleeve dogs radially away from the central longitudinal axis.

3. The setting tool of claim 2, further comprising:

a first sleeve piston located inside the body and configured to move the sleeve ramp along the central longitudinal axis relative to the set of sleeve dogs;

a second sleeve piston located inside the body and configured to move the sleeve ramp together with the set of sleeve dogs along the central longitudinal axis to open or close the sleeve; and a seal located around the body and configured to seal an inside of the casing so that a fracturing fluid reaches the set of sleeve dogs and the set of holding dogs but not an adjacent casing located downstream from the current casing.

4. The setting tool of claim 1, further comprising:

an accumulator that stores fluid under pressure and is configured to actuate a holding piston, a first sleeve piston and a second sleeve piston for moving the set of holding dogs and the set of sleeve dogs, wherein the holding piston, the first sleeve piston and the second sleeve piston are concentric to each other.

5. A system for fracturing a well, the system comprising:

a casing having plural openings that are covered by a sleeve when the sleeve is in a close position; and a setting tool configured to open the sleeve for fracturing operations, wherein the setting tool includes, a body extending along a central longitudinal axis X, a set of holding dogs located around the body;

a set of sleeve dogs located around the body;

a valve block connected to an end of the body and having plural hydraulic valves, the plural hydraulic valves being configured to allow a fluid under pressure, in and out of the body, to actuate the set of sleeve dogs;

a seal located on an outside of the body, and configured to face the casing, to fluidly insulate the sets of holding dogs and sleeve dogs from the valve block so that the fluid under pressure enters through the valve block to actuate the set of sleeve dogs;

a controller located inside the body; and a sensor located on the body and configured to measure a speed of the body relative to the casing, wherein the set of sleeve dogs are configured to move along the central longitudinal axis X relative to the set of holding dogs when the controller determines, based on an input from the sensor, that the body is at rest relative to the casing.

6. The system of claim 5, wherein the setting tool further comprises:

a holding ramp configured to slide under the set of holding dogs to move the holding dogs radially away from the central longitudinal axis.

7. The system of claim 6, wherein the setting tool further comprises:

a holding piston located inside the body and configured to move the holding ramp along the central longitudinal axis.

8. The system of claim 5, wherein the setting tool further comprises:

a sleeve ramp configured to slide under the set of sleeve dogs to move the sleeve dogs radially away from the central longitudinal axis.

9. The system of claim 8, wherein the setting tool further comprises:

a first sleeve piston located inside the body and configured to move the sleeve ramp along the central longitudinal axis relative to the set of sleeve dogs.

10. The system of claim 9, wherein the setting tool further comprises:

a second sleeve piston located inside the body and configured to move the sleeve ramp together with the set of sleeve dogs along the central longitudinal axis to open or close the sleeve.

11. The system of claim 5, wherein:

the seal directly presses against the casing.

12. The system of claim 5, wherein the setting tool further comprises:

an accumulator that stores fluid under pressure and is configured to actuate a holding piston, a first sleeve piston and a second sleeve piston for moving the set of holding dogs and the set of sleeve dogs.

13. The system of claim 12, wherein the holding piston, the first sleeve piston and the second sleeve piston are concentric to each other.

14. A method for fracturing a well, the method comprising:

lowering a setting tool inside a casing having plural openings covered by a sleeve;

engaging a set of holding dogs of the setting tool with a corresponding holding groove formed inside the casing;

determining with a controller located on the setting tool, based on input from a sensor configured to measure a speed of the setting tool relative to the casing, that the setting tool is at rest;

engaging a set of sleeve dogs of the setting tool with a corresponding sleeve groove formed in the sleeve, based on an instruction from the controller; and opening the sleeve by translating the sleeve dogs along a central longitudinal axis X, relative to the holding dogs, wherein the setting tool has a body and includes a valve block, which is connected to an end of the body and has plural hydraulic valves, the plural hydraulic valves being configured to allow a fluid under pressure, in and out of the body, to actuate the set of sleeve dogs, and a seal located on an outside of the body, and configured to face the casing, to fluidly insulate the sets of holding dogs and sleeve dogs from the valve block so that the fluid under pressure enters through the valve block to actuate the set of sleeve dogs.

15. The method of claim 14, further comprising:

fracturing a formation around the casing by pumping the fluid into the casing.

16. The method of claim 15, further comprising:

closing the sleeve by translating back the sleeve dogs along the central longitudinal axis X, relative to the holding dogs.

17. The method of claim 16, further comprising:

disengaging the holding dogs and the sleeve dogs from their respective grooves.

18. The method of claim 17, further comprising:

pumping the setting tool further down the well to the next casing.

19. The method of claim 14, wherein the step of opening comprises:

activating a sleeve piston for translating the sleeve dogs along the central longitudinal axis.

20. The method of claim 19, further comprising:

releasing from an accumulator a fluid under pressure for activating the sleeve piston; and recharging the accumulator by pumping the fluid into the well with a pump at a surface of the well.

* * * * *